US011618866B2

(12) United States Patent
Gomez et al.

(10) Patent No.: US 11,618,866 B2
(45) Date of Patent: Apr. 4, 2023

(54) HOME CARE COMPOSITION COMPRISING A POLYALKYLENEIMINE, ACID, AND SOLVENT MIXTURE

(71) Applicant: COLGATE-PALMOLIVE COMPANY, New York, NY (US)

(72) Inventors: Karla Gomez, Granada (MX); Cesar Rodriguez Cedillo, Naucalpan de Juarez (MX); Carlos Munoz Carrillo, CP (MX)

(73) Assignee: Colgate-Palmolive Company, New York, NY (US)

( * ) Notice: Subject to any disclaimer, the term of this patent is extended or adjusted under 35 U.S.C. 154(b) by 57 days.

(21) Appl. No.: 16/314,578

(22) PCT Filed: Dec. 20, 2018

(86) PCT No.: PCT/US2018/066905
§ 371 (c)(1),
(2) Date: Dec. 31, 2018

(87) PCT Pub. No.: WO2020/131080
PCT Pub. Date: Jun. 25, 2020

(65) Prior Publication Data
US 2021/0222094 A1 Jul. 22, 2021

(51) Int. Cl.

| | |
|---|---|
| ***C11D 1/29*** | (2006.01) |
| ***C11D 11/00*** | (2006.01) |
| ***C11D 1/14*** | (2006.01) |
| ***C11D 3/04*** | (2006.01) |
| ***C11D 3/20*** | (2006.01) |
| ***C11D 3/37*** | (2006.01) |
| ***C11D 3/43*** | (2006.01) |
| ***C11D 17/00*** | (2006.01) |

(52) U.S. Cl.
CPC ..... *C11D 11/0035* (2013.01); *C11D 1/146* (2013.01); *C11D 3/042* (2013.01); *C11D 3/2079* (2013.01); *C11D 3/3723* (2013.01); *C11D 3/43* (2013.01); *C11D 17/0008* (2013.01)

(58) Field of Classification Search
CPC ..... C11D 1/12
See application file for complete search history.

(56) References Cited

U.S. PATENT DOCUMENTS

| | | | | |
|---|---|---|---|---|
| 6,045,817 | A | 4/2000 | Ananthapadmanabhan et al. | |
| 9,309,485 | B2 | 4/2016 | Hunt, Jr. et al. | |
| 2003/0017960 | A1 | 1/2003 | Bertrem et al. | |
| 2005/0096239 | A1* | 5/2005 | Barnabas | C11D 3/3749 510/214 |
| 2006/0276356 | A1* | 12/2006 | Panandiker | C11D 7/3281 510/100 |
| 2008/0032911 | A1* | 2/2008 | Becker | C11D 3/042 510/528 |
| 2008/0234165 | A1* | 9/2008 | Panandiker | C11D 1/146 510/343 |
| 2010/0234268 | A1* | 9/2010 | Iverson | C11D 3/042 510/400 |
| 2015/0005222 | A1* | 1/2015 | Hunt, Jr. | C11D 1/83 510/407 |
| 2015/0353869 | A1* | 12/2015 | Stenger | C11D 17/042 510/324 |
| 2016/0120387 | A1* | 5/2016 | Deleersnyder | A47L 13/17 15/104.93 |
| 2017/0121637 | A1* | 5/2017 | Delplancke | C11D 11/0023 |
| 2018/0201880 | A1* | 7/2018 | Rivera Cruz | C11D 3/3723 |
| 2020/0221694 | A1* | 7/2020 | Purschwitz | A01N 33/04 |

FOREIGN PATENT DOCUMENTS

| | | |
|---|---|---|
| DE | 2161591 | 6/1973 |
| JP | 2008-50410 A | 3/2008 |
| WO | WO 2013/167401 A1 | 11/2013 |
| WO | 2017/010972 | 1/2017 |

OTHER PUBLICATIONS

International Search Report and Written Opinion in International Application No. PCT/US2018/066905, dated Sep. 13, 2019.

* cited by examiner

*Primary Examiner* — Charles I Boyer

(57) ABSTRACT

Described herein are aqueous cleaning compositions comprises a combination of polyalkylenimine and an acid, a surfactant, and a solvent mixture. Methods of making and using the same are also described.

7 Claims, No Drawings

HOME CARE COMPOSITION COMPRISING A POLYALKYLENEIMINE, ACID, AND SOLVENT MIXTURE

CROSS-REFERENCE TO RELATED APPLICATION

This application is a national stage entry under 35 U.S.C. § 371 of International patent Application No. PCT/US2018/66905, filed Dec. 20, 2018, the contents of which are hereby incorporated herein by reference in their entirety.

BACKGROUND

To clean windows, mirrors, glass surfaces, and any other non-porous surfaces, various cleaning compositions are used on a daily basis in millions of households around the world. After the application of cleaning compositions to the surfaces or substrates, for aesthetic reasons many users of the cleaning compositions desire to minimize any residue left on the substrate. The reduction of residues is particularly important for glass surfaces, such as mirrors and windows, which often easily show any residue. It is therefore desirable to use a cleaning composition that eliminates or reduces residue.

Cleaning compositions comprising at least one modified acrylic polyamide are disclosed in International Patent Publication No. WO 2017/010972. Disclosed therein are aqueous cleaning compositions comprising at least one surfactant, at least one modified acrylic polyamide present in the aqueous cleaning composition in an amount ranging from about 0.05% to about 2% by weight of the composition, and dipropylene glycol butyl ether. The cleaning compositions disclosed therein provide low residue and increased shine and provide long-lasting, persistent anti-fog properties to a substrate after cleaning. Also disclosed therein are methods of cleaning a substrate comprising applying the aqueous cleaning composition to the substrate and wiping, and the use of at least one surfactant, at least one modified acrylic polyamide, and dipropylene glycol butyl ether in an aqueous cleaning composition to provide shine, low residue, and persistent anti-fog properties to a substrate.

Quaternized polyethyleneimines with a high ethoxylation degree are disclosed in International Patent Publication No. WO 2013/167401. That disclosure relates to an ethoxylated polyethyleneimine polymer comprising (1) a polyethyleneimine backbone, (2) a polyoxyethylene chain wherein the polyoxyethylene chain has an average of 40 to 90 ethyleneoxide units per unit of NH in the polyethyleneimine backbone, and (3) a quaternization degree of from 1% to less than 50%.

Ultramild antibacterial cleaning composition for frequent use is disclosed in U.S. Pat. No. 6,045,817. An antibacterial cleaning composition is described which has about 0.05 to about 1 wt % of a cationic polymer having a charge density of 0.0025 or higher, about 0.2 to about 5 wt % of a zwitterionic surfactant, about 0.2 to about 5 wt % of at least one biguanide compound, and optionally, a nonionic surfactant and a polymeric biocide compound. The composition has a pH of 7.5 or greater.

Granular cleanser composition for automatic tableware washer and method for producing the composition, and method for using the composition are disclosed in Japanese Patent P5213091.

Although many advances in the art of formulating glass cleaner compositions have been made with respect to improving its ability to increase the surface wettability, many more challenges remain.

BRIEF SUMMARY

The present invention is directed to an aqueous cleaning composition comprising a combination of polyalkylenimine and an acid, wherein the combination has a pH of less than about 4.0; a surfactant; and a solvent mixture. The polyalkylenimine and the acid are combined together before the addition of any of the other ingredients. The cleaning composition is suitable to clean substrates by applying the composition to a substrate and wiping the substrate. Under one embodiment, the cleaning composition is formulated as a glass cleaner.

The aqueous cleaning solution comprises a combination of polyalkylenimine and an acid. The polyalkylenimine and the acid are combined together prior to the addition of any of the other ingredients. The combination polyalkylenimine and an acid may be a mixture of polyalkylenimine and an acid, or a reaction product of polyalkylenimine and an acid, or a mixture of polyalkylenimine, an acid, and a reaction product of polyalkylenimine with the acid.

Polyalkylenimine is a polymer of formula $—[(CH_2)_x NR]_n—$, wherein x is 1 to 6, n is 10 to several hundred thousand, and R is either H or another $—[(CH_2)_xNR]—$ unit. The polymer is capped by H.

Under one embodiment, the polyalkylenimine is polyethyleneimine. The polyethyleneimine may be branched, comprising primary, secondary and tertiary amine groups. The branched polyethyleneimine may be in a hyperbranched or a dendrimeric form.

The polyalkylenimine may comprise about 10% to about 30% primary amines, about 30% to about 70% secondary amines, and about 20% to about 40% tertiary amines. Alternatively, the aqueous cleaning composition may comprise polyalkylenimine which comprises about 5% to about 10% primary amines, about 20% to about 60% secondary amines, and about 20% to 40% tertiary amines. Further, the aqueous cleaning composition may comprise polyethyleneimine that has a ratio of primary to secondary to tertiary amines within 10% that in Lupasol PN60.

The acid is mixed with the polyalkylenimine to yield a combination of polyalkylenimine and the acid. The combination of the polyalkylenimine and the acid has a pH of less than about 4.0. The acid may be a strong acid or a week acid. The acid may be an organic acid or an inorganic acid. The acid may be selected from the group consisting of hydrochloric acid, sulfuric acid, phosphoric acid, acetic acid, formic acid, and mixtures thereof. The pH of the combination before being mixed with other ingredients that make up the aqueous cleaning product is less than about 4.0, or less than about 3.5, or less than about 3.5, or less than about 3.0, or about 2.0.

The cleaning composition comprises at least one surfactant. The surfactant may be a detergent, a wetting agent, an emulsifier, a foaming agent, a dispersant, or a solvent. The surfactant may be chosen from any anionic, amphoteric, zwitterionic surfactants, or any mixture thereof. The surfactant may be a single surfactant or a mixture of surfactants.

An anionic surfactant contains an anionic functional group, such as sulfate, sulfonate, phosphate, and carboxylates. The surfactant may comprise the salt of an alkyl ether sulfate, wherein the alkyl is an alkyl group with 10 to 14 carbons. The surfactant may be sodium lauryl ether sulfate. Further, the surfactant may comprise a triethanolamine alkyl sulfate, such as triethanolamine lauryl sulfate. The composition may also include an amine oxide surfactant. The aqueous cleaning composition may comprise about 0.05 wt % to about 2 wt % surfactant, or up to about 0.5 wt % surfactant.

The solvent mixture comprises two or more solvents. Any of the solvents in the solvent mixture may be a mixture of selected compounds, some of which act as a solvent. The solvent mixture may comprise a glycol ether and an alcohol. Additional solvents, such as water, may be present in the aqueous cleaning composition in addition to the glycol ether and the alcohol.

Glycol ether solvent has the formula R—O—$(CH_2CH_2O)_m$—$CH_2CH_2$—OH, wherein m=0 or 1, and R is hydrocarbyl group comprising 1 to 7 carbons. The glycol ether may be present in an amount ranging from about 0.1% to about 2% by weight of the composition, or to about 2%.

The alcohol is a compound comprising a hydroxyl functional group bound to a carbon. The alcohol may be a primary alcohol, secondary alcohol, or a tertiary alcohol. The alcohol may be ethanol. The alcohol may be present in an amount ranging from about 0.1% to about 10% by or from about 1% to about 4% by weight of the composition. Water is the major component of the aqueous cleaning solution.

The composition may also be a concentrate, comprising lower amounts of water. The customer, or an intermediate party, dilutes the concentrate with water to obtain a suitable solution The definition of the phrase "aqueous cleaning solution" includes concentrates that contain some or little water.

The aqueous cleaning composition may also additionally comprise an additive. Examples of additives include acids, bases, polysaccharides, colorants, fragrances, preservatives and like.

The aqueous cleaning composition of the present invention may comprise a combination of a branched polyethyleneimine and an acid selected from the group consisting of hydrochloric acid, phosphoric acid, acetic acid, and mixtures thereof, wherein the combination has a pH of less than about 2.5; sodium lauryl ether sulfate; and a solvent mixture comprising ethanol, propylene glycol n-butyl ether, and propylene glycol.

The present invention is also directed to an aqueous cleaning composition comprising a combination of polyalkylenimine and an acid; a surfactant; a solvent mixture; and optionally, an additive, wherein the composition is a glass cleaner.

The present invention is also directed to a method of cleaning a substrate. This method comprises the steps of applying the aqueous cleaning composition to a substrate; and wiping the composition across the substrate. This two-step method is performed in this sequence: first, in the application step, the aqueous cleaning composition is applied to a substrate; second, in the wiping step, the composition is wiped across the substrate.

The application step delivers the aqueous cleaning composition to a portion of the substrate or to all of the substrate which is desired to be cleaned.

The wiping step is performed to provide a coating of the aqueous cleaning composition to the entire substrate which the user desires to clean, and to remove the aqueous cleaning composition, along with any dirt or debris carried away by the aqueous cleaning composition At least twenty-three aspects define the invention.

In the first aspect, the invention relates to an aqueous cleaning composition comprising: a combination of polyalkylenimine and an acid, wherein the combination has a pH of less than about 4.0; a surfactant; and a solvent mixture.

In the second aspect, the invention relates to an aqueous cleaning composition comprising: a combination of polyalkylenimine and an acid, wherein the combination has a pH of less than about 4.0; a surfactant; and a solvent mixture, wherein the polyalkylenimine is branched.

In the third aspect, the invention relates to an aqueous cleaning composition comprising: a combination of polyethyleneimine and an acid, wherein the combination has a pH of less than about 4.0; a surfactant; and a solvent mixture, In the fourth aspect, the invention relates to an aqueous cleaning composition comprising: a combination of polyalkylenimine and an acid, wherein the combination has a pH of less than about 4.0; a surfactant; and a solvent mixture, wherein the polyalkylenimine comprises about 10% to about 30% primary amines, about 30% to about 70% secondary amines, and about 20% to 40% tertiary amines.

In the fifth aspect, the invention relates to an aqueous cleaning composition comprising: a combination of polyalkylenimine and an acid, wherein the combination has a pH of less than about 4.0; a surfactant; and a solvent mixture, wherein the polyalkylenimine comprises about 5% to about 10% primary amines, about 20% to about 60% secondary amines, and about 20% to 40% tertiary amines.

In the sixth aspect, the invention relates to an aqueous cleaning composition comprising: a combination of polyethyleneimine and an acid, wherein the combination has a pH of less than about 4.0; a surfactant; and a solvent mixture, wherein the polyethyleneimine has a ratio of primary to secondary to tertiary amines within 10% that in Lupasol PN60.

In the seventh aspect, the invention relates to an aqueous cleaning composition comprising: a combination of polyalkylenimine and an acid, wherein the combination has a pH of less than about 4.0; a surfactant; and a solvent mixture, wherein the polyalkylenimine is present in an amount ranging from about 0.001 wt % to about 0.5 wt %.

In the eighth aspect, the invention relates to an aqueous cleaning composition comprising: a combination of polyalkylenimine and an acid, wherein the combination has a pH of less than about 4.0; a surfactant; and a solvent mixture, wherein the polyalkylenimine is present in an amount ranging from about 0.001 wt % to about 0.01 wt %.

In the ninth aspect, the invention relates to an aqueous cleaning composition comprising: a combination of polyalkylenimine and an acid, wherein the combination has a pH of less than about 4.0; a surfactant comprising an anionic surfactant; and a solvent mixture, In the tenth aspect, the invention relates to an aqueous cleaning composition comprising: a combination of polyalkylenimine and an acid, wherein the combination has a pH of less than about 4.0; a surfactant comprising an anionic surfactant; and a solvent mixture, wherein the anionic surfactant is selected from the group consisting of alkyl ether sulfate, triethanolamine alkyl sulfate, and mixtures thereof.

In the eleventh aspect, the invention relates to an aqueous cleaning composition comprising: a combination of polyalkylenimine and an acid, wherein the combination has a pH of less than about 4.0; a surfactant comprising an anionic surfactant; and a solvent mixture, wherein the anionic surfactant is sodium lauryl ether sulfate.

In the twelfth aspect, the invention relates to an aqueous cleaning composition comprising: a combination of polyalkylenimine and a strong acid, wherein the combination has a pH of less than about 4.0; a surfactant; and a solvent mixture.

In the thirteenth aspect, the invention relates to an aqueous cleaning composition comprising: a combination of polyalkylenimine and an organic acid, wherein the combination has a pH of less than about 4.0; a surfactant; and a solvent mixture.

In the fourteenth aspect, the invention relates to an aqueous cleaning composition comprising: a combination of polyalkylenimine and an acid, wherein the combination has a pH of less than about 4.0; a surfactant; and a solvent mixture, wherein the acid is selected from the group consisting of hydrochloric acid, sulfuric acid, phosphoric acid, acetic acid, formic acid, and mixtures thereof.

In the fifteenth aspect, the invention relates to an aqueous cleaning composition comprising: a combination of polyalkylenimine and an acid, wherein the combination has a pH of less than about 4.0; a surfactant; and a solvent mixture, wherein the acid is selected from the group consisting of hydrochloric acid, phosphoric acid, acetic acid, and mixtures thereof.

In the sixteenth aspect, the invention relates to an aqueous cleaning composition comprising: a combination of polyalkylenimine and an acid, wherein the combination has a pH of less than about 2.5; a surfactant; and a solvent mixture.

In the seventeenth aspect, the invention relates to an aqueous cleaning composition comprising: a combination of polyalkylenimine and an acid, wherein the combination has a pH of less than about 4.0; a surfactant; and a solvent mixture comprising a glycol ether and an alcohol.

In the eighteenth aspect, the invention relates to an aqueous cleaning composition comprising: a combination of polyalkylenimine and an acid, wherein the combination has a pH of less than about 4.0; a surfactant; and a solvent mixture comprising a glycol ether and ethanol.

In the nineteenth aspect, the invention relates to an aqueous cleaning composition comprising: a combination of polyalkylenimine and an acid, wherein the combination has a pH of less than about 4.0; a surfactant; and a solvent mixture comprising propylene glycol butyl ether and an alcohol.

In the twentieth aspect, the invention relates to an aqueous cleaning composition comprising: a combination of polyalkylenimine and an acid, wherein the combination has a pH of less than about 4.0; a surfactant; and a solvent mixture, wherein the composition is a glass cleaner.

In the twenty-first aspect, the invention relates to a method of cleaning a substrate, the comprising the steps of: applying the an aqueous cleaning composition comprising: a combination of polyalkylenimine and an acid, wherein the combination has a pH of less than about 4.0, a surfactant, and a solvent mixture, to a substrate; and wiping the composition across the substrate.

In the twenty-second aspect, the invention relates to an aqueous cleaning composition comprising a combination of a branched polyethyleneimine and an acid selected from the group consisting of hydrochloric acid, phosphoric acid, acetic acid, and mixtures thereof, wherein the combination has a pH of less than about 2.5; sodium lauryl ether sulfate; and a solvent mixture comprising ethanol, propylene glycol n-butyl ether, and propylene glycol.

In the twenty-third aspect, the invention relates to an aqueous cleaning composition comprising about 0.001 wt % to about 0.5 wt % of a combination of a branched polyethyleneimine and an acid selected from the group consisting of hydrochloric acid, phosphoric acid, acetic acid, and mixtures thereof, wherein the combination has a pH of less than about 2.5; about 0.1 wt % to about 2 wt % of sodium lauryl ether sulfate; about 0.1 wt % to about 3 wt % of ethanol; about 0.1 wt % to about 5.0 wt % of propylene glycol n-butyl ether, and about 0.1 wt % to about 2.0 wt % of propylene glycol.

DETAILED DESCRIPTION

For illustrative purposes, the principles of the present invention are described by referencing various exemplary embodiments thereof. Although certain embodiments of the invention are specifically described herein, one of ordinary skill in the art will readily recognize that the same principles are equally applicable to, and can be employed in other apparatuses and methods. Before explaining the disclosed embodiments of the present invention in detail, it is to be understood that the invention is not limited in its application to the details of any particular embodiment shown. The terminology used herein is for the purpose of description and not of limitation.

As used herein and in the appended claims, the singular forms "a", "an", and "the" include plural references unless the context dictates otherwise. The singular form of any class of the ingredients refers not only to one chemical species within that class, but also to a mixture of those chemical species; for example, the term "solvent" in the singular form, may refer to a mixture of compounds each of which is also a solvent. The terms "a" (or "an"), "one or more" and "at least one" may be used interchangeably herein. The terms "comprising", "including", and "having" may be used interchangeably. The term "include" should be interpreted as "include, but are not limited to". The term "including" should be interpreted as "including, but are not limited to".

The abbreviations and symbols as used herein, unless indicated otherwise, take their ordinary meaning. The abbreviation "wt %" means percent by weight. The symbol "μL" refers to a microliter, or $10^{-6}$ liters. The symbol "°" refers to a degree, including a degree of an angle.

The symbol "±" in a numerical notation indicates a 95% confidence interval about a mean; for example, the numerical notation "27.8±4.9" indicates a mean of 27.8, with a 95% confidence interval (or about 1.96 standard deviations) of ±4.9, or a 95% confidence interval range from 22.9 to 32.7.

When referring to chemical structures, and names, the symbols "C", "H", and "O" mean carbon, hydrogen, and oxygen, respectively. The symbols "—" and "═" mean single bond, and double bond, respectively.

The term "about" when referring to a number means any number within a range of 10% of the number. For example, the phrase "about 0.050 wt %" refers to a number between and including 0.04500 wt % and 0.05500 wt %.

As used throughout, ranges are used as shorthand for describing each and every value that is within the range. Any value within the range can be selected as the terminus of the range.

As used throughout the disclosure and claims, the term "combination" in absence of indication of what is combined, means a "combination of polyalkylenimine and an acid".

The term "mixture" is to be interpreted broadly. It refers to a solution, an emulsion, a dispersion, a mixture displaying the Tyndall effect, or any other homogeneous mixture. Under one embodiment, the mixture is shelf stable. When referring to a list of ingredients, unless specifically indicated otherwise, the term "mixture" refers to a mixture of the aforementioned ingredients with each other, a mixture of any of aforementioned ingredients with other ingredients that are not aforementioned, and to a mixture of several aforementioned ingredients with other ingredients that are not aforementioned. For example, the term "mixture" in the phrase "the anionic surfactant selected from the group consisting of alkyl ether sulfate, triethanolamine alkyl sulfate, and mixtures thereof" refers to any of the following: a mixture of alkyl ether sulfate and triethanolamine alkyl sulfate; or a mixture of alkyl ether sulfate and any other anionic surfactant; or a mixture of triethanolamine alkyl sulfate and any other anionic surfactant; or a mixture of alkyl ether sulfate, triethanolamine alkyl sulfate, and any other anionic surfactant. For each of these, the phrase "any other anionic surfactant" means one or more anionic surfactant besides alkyl ether sulfate or triethanolamine alkyl sulfate.

Any member in a list of species that are used to exemplify or define a genus, may be mutually different from, or overlapping with, or a subset of, or equivalent to, or nearly the same as, or identical to, any other member of the list of species. Further, unless explicitly stated, such as when reciting a Markush group, the list of species that define or exemplify the genus is open, and it is given that other species may exist that define or exemplify the genus just as well as, or better than, any other species listed.

All references cited herein are hereby incorporated by reference in their entireties. In the event of a conflict in a definition in the present disclosure and that of a cited reference, the present disclosure controls The present invention is directed to an aqueous cleaning composition comprising a combination of polyalkylenimine and an acid, wherein the combination has a pH of less than about 4.0; a surfactant; and a solvent mixture. The polyalkylenimine and the acid are combined together prior to the addition of any of the other ingredients.

The cleaning compositions is suitable to clean substrates by applying the composition to a substrate and wiping the substrate. Under one embodiment, the cleaning composition is formulated as a glass cleaner.

One of the advantages of the present invention is that after the treatment of a glass substrate by the aqueous cleaning composition, the contact angle of a water droplet on the treated glass substrate is smaller compared to an untreated glass substrate.

Further, one of the advantages of the present invention is that after the treatment of a glass substrate by the aqueous cleaning composition, the contact angle of a water droplet on the treated glass substrate is smaller compared to the contact angle of a water droplet on a glass substrate that has been treated with a commercially available formulation Wetting, the ability of a liquid to maintain a contact with a solid substrate, results from intermolecular interactions when the liquid is placed in contact with the solid substrate. Wettability, the degree of wetting, is controlled by chemical composition, morphology and free energy of the surface. The present invention provides an aqueous cleaning composition over existing formulations, including a hydrophilic hyperbranched cationic polymer with an acid.

The observed unexpected improvement of lower contact angle exhibited by glass cleaner compositions are not well understood. While not wishing to be bound by theory, it is believed that the observed decrease in contact angle is related to the mechanism of hyperbranched cationic polymer with acid, specifically due to protonation of amine functional group. At low temperature or at room temperature, an acid-base reaction occurs between the primary amine of the hyperbranched cationic polymer carboxylic acid group of organic acid to yield a polyamide. Salts of ammonium carboxylate form upon protonation by interaction with organic acid. Alkyl ammonium salts will form upon protonation by inorganic acid. These acid-base interactions play the main role in the formation of interfacial forces between hyperbranched cationic polymer and glass surface. The hydroxylic ion formed by this reaction will interact with the silanol groups of the glass surface by hydrogen bond, increasing the wettability behavior The aqueous cleaning solution comprises a combination of polyalkylenimine and an acid. The polyalkylenimine and the acid are combined together prior to the addition of any of the other ingredients. Under one embodiment, the combination may be then added to other ingredients. Under one embodiment, the other ingredients may be then added to the combination.

The phrase "combination of polyalkylenimine and an acid" means that polyalkylenimine is combined with the acid. The term "combination" should be interpreted broadly. Examples of the "combination polyalkylenimine and an acid" include a mixture of polyalkylenimine and an acid; a reaction product of polyalkylenimine and an acid; a mixture of polyalkylenimine, an acid, and a reaction product of polyalkylenimine with the acid; and like.

The physical state of the combination of polyalkylenimine and an acid is broad. Under one embodiment, the combination is a liquid. Under one embodiment, the combination is a solution. Under one embodiment, the combination is a mixture of a liquid and a solid. Under one embodiment, the combination is a dispersion. Under one embodiment, the combination displays the Tyndall effect. Under one embodiment, the combination is a homogeneous mixture. Under one embodiment, the combination is shelf stable.

Polyalkylenimine is a polymer of formula —$[(CH_2)_x NR]_n$—, wherein x is 1 to 6, n is 10 to several hundred thousand, and R is either H or another —$[(CH_2)_x NR]$— unit. The polymer is capped by H. Under one embodiment, the polyalkylenimine is a polyamine.

Under one embodiment, the polyalkylenimine is polyethyleneimine. Polyethyleneimine, or polyethylenimine or PEI, or polyaziridine, is a polymer with repeating unit composed of the amine group and two carbon aliphatic $CH_2CH_2$ linker. Under one embodiment, polyethyleneimine is a linear polyethyleneimine, which contains all secondary amines. Under one embodiment, polyethyleneimine is branched, comprising primary, secondary and tertiary amine groups. Under one embodiment, the branched polyethyleneimine is in hyperbranched or dendrimeric form.

Under one embodiment, the polyalkylenimine is branched. An example of branched polyalkylenimine is branched polyethyleneimine. A typical fragment of a branched polyethyleneimine is

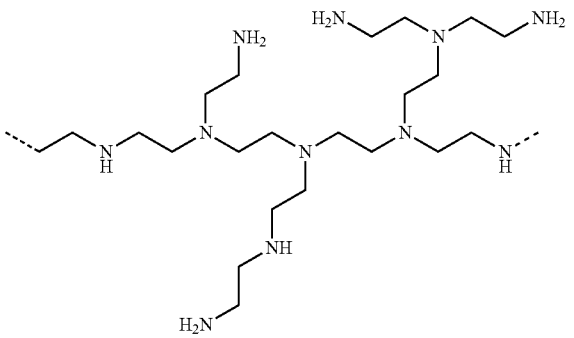

Branched polyethyleneimine may be synthesized by the ring opening polymerization of aziridine. Depending on the reaction conditions different degree of branching can be achieved.

The term "branched" as in "branched polymer", refer to any of different types branching, including hyperbranched and dendrimeric. Examples of a branched polymer include a dendrimer polymer, hyperbranched polymer, linear-dendritic hybrid polymer, multi-arm star polymer, hypergrafted polymer, dendronized polymer, dendrigrafted polymer, and mixtures thereof.

Under one embodiment, the polyethyleneimine comprises about 5% to about 15% of a primary amine, about 5% to about 15% of a secondary amine, and about 75% to about 85% of a tertiary amine. Under one embodiment, the polyethyleneimine comprises about 15% to about 25% of a primary amine, about 5% to about 15% of a secondary amine, and about 65% to about 75% of a tertiary amine. Under one embodiment, the polyethyleneimine comprises about 25% to about 35% of a primary amine, about 5% to about 15% of a secondary amine, and about 55% to about 65% of a tertiary amine. Under one embodiment, the polyethyleneimine comprises about 35% to about 45% of a primary amine, about 5% to about 15% of a secondary amine, and about 45% to about 55% of a tertiary amine. Under one embodiment, the polyethyleneimine comprises about 45% to about 55% of a primary amine, about 5% to about 15% of a secondary amine, and about 35% to about 45% of a tertiary amine. Under one embodiment, the polyethyleneimine comprises about 55% to about 65% of a primary amine, about 5% to about 15% of a secondary amine, and about 25% to about 35% of a tertiary amine. Under one embodiment, the polyethyleneimine comprises about 65% to about 75% of a primary amine, about 5% to about 15% of a secondary amine, and about 15% to about 25% of a tertiary amine. Under one embodiment, the polyethyleneimine comprises about 75% to about 85% of a primary amine, about 5% to about 15% of a secondary amine, and about 5% to about 15% of a tertiary amine.

Under one embodiment, the polyethyleneimine comprises about 5% to about 15% of a primary amine, about 15% to about 25% of a secondary amine, and about 65% to about 75% of a tertiary amine. Under one embodiment, the polyethyleneimine comprises about 15% to about 25% of a primary amine, about 15% to about 25% of a secondary amine, and about 55% to about 65% of a tertiary amine. Under one embodiment, the polyethyleneimine comprises about 25% to about 35% of a primary amine, about 15% to about 25% of a secondary amine, and about 45% to about 55% of a tertiary amine. Under one embodiment, the polyethyleneimine comprises about 35% to about 45% of a primary amine, about 15% to about 25% of a secondary amine, and about 35% to about 45% of a tertiary amine. Under one embodiment, the polyethyleneimine comprises about 45% to about 55% of a primary amine, about 15% to about 25% of a secondary amine, and about 25% to about 35% of a tertiary amine. Under one embodiment, the polyethyleneimine comprises about 55% to about 65% of a primary amine, about 15% to about 25% of a secondary amine, and about 15% to about 25% of a tertiary amine. Under one embodiment, the polyethyleneimine comprises about 65% to about 75% of a primary amine, about 15% to about 25% of a secondary amine, and about 5% to about 15% of a tertiary amine.

Under one embodiment, the polyethyleneimine comprises about 5% to about 15% of a primary amine, about 25% to about 35% of a secondary amine, and about 55% to about 65% of a tertiary amine. Under one embodiment, the polyethyleneimine comprises about 15% to about 25% of a primary amine, about 25% to about 35% of a secondary amine, and about 45% to about 55% of a tertiary amine. Under one embodiment, the polyethyleneimine comprises about 25% to about 35% of a primary amine, about 25% to about 35% of a secondary amine, and about 35% to about 45% of a tertiary amine. Under one embodiment, the polyethyleneimine comprises about 35% to about 45% of a primary amine, about 25% to about 35% of a secondary amine, and about 25% to about 35% of a tertiary amine. Under one embodiment, the polyethyleneimine comprises about 45% to about 55% of a primary amine, about 25% to about 35% of a secondary amine, and about 15% to about 25% of a tertiary amine. Under one embodiment, the polyethyleneimine comprises about 55% to about 65% of a primary amine, about 25% to about 35% of a secondary amine, and about 5% to about 15% of a tertiary amine.

Under one embodiment, the polyethyleneimine comprises about 5% to about 15% of a primary amine, about 35% to about 45% of a secondary amine, and about 45% to about 55% of a tertiary amine. Under one embodiment, the polyethyleneimine comprises about 15% to about 25% of a primary amine, about 35% to about 45% of a secondary amine, and about 35% to about 45% of a tertiary amine. Under one embodiment, the polyethyleneimine comprises about 25% to about 35% of a primary amine, about 35% to about 45% of a secondary amine, and about 25% to about 35% of a tertiary amine. Under one embodiment, the polyethyleneimine comprises about 35% to about 45% of a primary amine, about 35% to about 45% of a secondary amine, and about 15% to about 25% of a tertiary amine. Under one embodiment, the polyethyleneimine comprises about 45% to about 55% of a primary amine, about 35% to about 45% of a secondary amine, and about 5% to about 15% of a tertiary amine.

Under one embodiment, the polyethyleneimine comprises about 5% to about 15% of a primary amine, about 45% to about 55% of a secondary amine, and about 35% to about 45% of a tertiary amine. Under one embodiment, the polyethyleneimine comprises about 15% to about 25% of a primary amine, about 45% to about 55% of a secondary amine, and about 25% to about 35% of a tertiary amine. Under one embodiment, the polyethyleneimine comprises about 25% to about 35% of a primary amine, about 45% to about 55% of a secondary amine, and about 15% to about 25% of a tertiary amine. Under one embodiment, the polyethyleneimine comprises about 35% to about 45% of a primary amine, about 45% to about 55% of a secondary amine, and about 5% to about 15% of a tertiary amine.

Under one embodiment, the polyethyleneimine comprises about 5% to about 15% of a primary amine, about 55% to about 65% of a secondary amine, and about 25% to about 35% of a tertiary amine. Under one embodiment, the polyethyleneimine comprises about 15% to about 25% of a primary amine, about 55% to about 65% of a secondary amine, and about 15% to about 25% of a tertiary amine. Under one embodiment, the polyethyleneimine comprises about 25% to about 35% of a primary amine, about 55% to about 65% of a secondary amine, and about 5% to about 15% of a tertiary amine.

Under one embodiment, the polyethyleneimine comprises about 5% to about 15% of a primary amine, about 65% to about 75% of a secondary amine, and about 15% to about 25% of a tertiary amine. Under one embodiment, the polyethyleneimine comprises about 15% to about 25% of a primary amine, about 65% to about 75% of a secondary amine, and about 5% to about 15% of a tertiary amine. Under one embodiment, the polyethyleneimine comprises about 5% to about 15% of a primary amine, about 75% to about 85% of a secondary amine, and about 5% to about 15% of a tertiary amine.

Branched polyethyleneimine may be commercially available from BASF (Ludwigshafen, Germany), Nippon Shokubai (Osaka, Japan), Wuhan Qianglong Chemical (Wuhan, China), Gobekie Co (Shanghai, China), and Shaoxing Xingxin Chemical Co Ltd. (Shaoxing, China).

Under one embodiment, the polyalkylenimine comprises about 10% to about 30% primary amines, about 30% to about 70% secondary amines, and about 20% to about 40% tertiary amines.

Further, under one embodiment, the aqueous cleaning composition comprises polyalkylenimine which comprises about 5% to about 10% primary amines, about 20% to about 60% secondary amines, and about 20% to 40% tertiary amines.

Also, under one embodiment, the aqueous cleaning composition comprises polyethyleneimine that has a ratio of primary to secondary to tertiary amines within 10% that in Lupasol PN60.

Polyethyleneimine, exemplified by Lupasol PN 60, is a highly-branched or hyperbranched polyamine structure having the general molecular formula $—[CH_2—CH_2—NR]_n—$, wherein $10<n<10^5$, and R is either H or another $—[CH_2—CH_2NR]—$ unit. The polyethyleneimine has a nitrogen to carbon ratio of 1:2.

It was found that even a small amount of polyethyleneimine in a glass cleaner is effective in decreasing the contact angle of a water droplet on a glass plate treated by said glass cleaner. In certain embodiments, the aqueous cleaning composition is effective when the polyethyleneimine is present in an amount ranging from about 0.001 wt % to about 0.5 wt % with respect to the aqueous cleaning composition. In certain embodiments, the aqueous cleaning composition is effective when the polyethyleneimine is present in an amount ranging from about 0.001 wt % to about 0.01 wt % with respect to the aqueous cleaning composition. The percentages by weight of the polyethyleneimine are described herein as the percentages by weight contributed to the aqueous cleaning composition by the polymer itself without any solvents, as weighed prior to the combination with the acid.

The aqueous cleaning composition of the present invention comprises a combination of polyalkylenimine and an acid.

The acid is mixed with the polyalkylenimine to yield a combination of polyalkylenimine and the acid. The combination of the polyalkylenimine and the acid has a pH of less than about 4.0.

Under one embodiment, the acid is a strong acid. A strong acid is an acid that dissociates according to the reaction $HA+S \rightarrow SH^+ + A^-$, where S represents a solvent molecule, such as a molecule of water, to such an extent that the concentration of the undissociated species HA is too low to be measured. Suitable strong acids include HCl, hydrochloric acid, $HNO_3$, nitric acid, $H_2SO_4$, sulfuric acid, HBr, hydrobromic acid, HI, hydroiodic acid, $HClO_4$, perchloric acid, $HClO_3$, chloric acid, and mixtures thereof.

Under one embodiment, the acid is an organic acid. An organic acid is an organic compound with acidic properties. The most common organic acids are the carboxylic acids, the acidity of which is associated with their carboxyl group —COOH and sulfonic acids, containing the group $—SO_2OH$. Under one embodiment, the term organic acid also refers to an organic compound containing an alcohol group —OH, or a thiol group —SH.

Examples of suitable organic acids include acetic acid, formic acid, citric acid, oxalic acid, uric acid, butyric acid, maleic acid, oleic acid, oxalic acid, stearic acid, tartaric acid, and mixtures thereof.

Under one embodiment, the acid is selected from the group consisting of hydrochloric acid, sulfuric acid, phosphoric acid, acetic acid, formic acid, and mixtures thereof. Under one embodiment, the acid is selected from the group consisting of hydrochloric acid, phosphoric acid, acetic acid, and mixtures thereof.

The pH of the combination prior to being mixed with other ingredients that make up the aqueous cleaning product is less than about 4.0. Under one embodiment, the pH is less than about 3.5. Under one embodiment, the pH is less than about 3.5. Under one embodiment, the pH is less than about 3.0. Under one embodiment, the pH is less than about 2.5. Under one embodiment, the pH is about 2.0.

The cleaning composition comprises at least one surfactant. The term surfactant refers to any compound that lower the surface tension between two liquids, between a gas and a liquid, or between a liquid and a solid. A surfactant may act as a detergent, a wetting agent, an emulsifier, a foaming agent, a dispersant, a solvent, or any combination of the preceding.

The surfactant may be chosen from any anionic, amphoteric, zwitterionic surfactants, or any mixture thereof. Under one embodiment, the surfactant is a single surfactant. Under another embodiment the surfactant is a mixture of surfactants. Exemplary mixtures include a mixture of an anionic surfactant and an amphoteric surfactant; a mixture of an anionic surfactant and a zwitterionic surfactant; and a mixture of an amphoteric surfactant and a zwitterionic surfactant.

An anionic surfactant contains an anionic functional group, such as sulfate, sulfonate, phosphate, and carboxylates. Examples of suitable anionic surfactants include ammonium lauryl sulfate, sodium lauryl sulfate, sodium dodecyl sulfate, SLS, SDS, alkyl-ether sulfate, sodium laureth sulfate, sodium lauryl ether sulfate, SLES, and sodium myreth sulfate. Additional suitable anionic surfactants include docusate, dioctyl sodium sulfosuccinate, perfluorooctanesulfonate, PFOS, perfluorobutanesulfonate, alkylaryl ether phosphates, and alkyl ether phosphates.

Examples of counter ions for the anionic surfactant include a metal ion, an ammonium ion, or an amine. Examples of metal cations include, alkali metal ions and alkaline earth ions. In some embodiments, the metal cation ion is lithium, sodium, potassium, magnesium, or calcium. In some embodiments, the amine is triethanolamine.

In one embodiment, the surfactant comprises the salt of an alkyl ether sulfate. In one embodiment, the alkyl is an alkyl group with 10 to 14 carbons. In one embodiment the surfactant is a sodium lauryl ether sulfate or sodium laureth sulfate. In one embodiment, there are about 1 to about 10 moles of ethylene oxide per mole of sodium lauryl ether sulfate. In another embodiment, there is an average of about 2 to about 3 moles of ethylene oxide per mole of sodium lauryl ether sulfate.

In another embodiment, the surfactant comprises a triethanolamine alkyl sulfate. In one embodiment, the alkyl in the triethanolamine alkyl sulfate is a straight alkyl group of 10 to 14 carbons. In another embodiment the at least one surfactant comprises a triethanolamine lauryl sulfate.

Examples of anionic surfactants include lithium dodecyl sulfate, sodium octyl sulfate, decyltrimethylammonium chloride, cetyldimethylethylammonium bromide, potassium oleate, sodium pentanesulfonate, sodium dodecyl sulfate, butylnaphthalenesulfonic acid sodium salt, 4-morpholineethanesulfonic acid, sodium 1-butanesulfonate, sodium decyl sulfate, calcium salt of lignosulfonic acid, sodium dodecylbenzenesulphonate, sodium stearate, magnesium stearate, 1-dodecanesulfonic acid sodium salt, sodium allylsulfonate, 3-(N,N-dimethylpalmitylammonio)propanesulfonate, sulfonated castor oil, 2,6-dimorpholin-4-ylpyrimidine-4-carboxylic acid, disodium methylenebisnaphthalenesulphonate, sodium oleyl sarcosinate, sodium alkylbenzene sulfonate, hydroxyaluminum distearate, sodium diisobutyl sulfosuccinate, dodecylbenzenesulfonic acid sodium salt, dicyclohexyl sulfosuccinate sodium salt, disodium 4-dodecyl-2,4'-oxydibenzenesulfonate, linear alklybezene sulfonates, organosilicon surfactant, sulfonated aliphatic polyester, sodium N-methyl-n-oleyol taurate, di-n-hexyl sodium sulfosccinate, dibasic lead stearate, sodium n-octylsufonate, dodecyl triethanolamine sulfate, sodium diamyl sulfosuccinate, manganous stearate, calcium dodecylbenzene sulfonate, disodium 4-[2-[(1-oxoundec-10-enyl)amino]ethyl] 2-sulphonatosuccinate, fluorocarbon surfactant, Lamepon A, sodium poly[(naphthaleneformaldehyde)sulfonate], 1-hexadecanesulfonic acid sodium salt, ammonium lauryl sulfate, 1-pentanesulfonic acid sodium salt, sodium lignosulfonate, dodecylbenzenesulphonic acid, sodium lauryl polyoxyethylene ether sulfate, amidoaminosurfactans, Jiuma plate amino-acid surfactant, sodium nonylphenol polyoxyethylene ether sulfate, sodium dodecyl sulfate, fatty alcohol ammonium sulfate, lauryl polyoxyethylene ether triethanol amine salt, dodecyl phenyl ammonium sulfate, sodium pyrrolidone carbonate, N-acyl glutamate potassium salt, sodium polyalkyl phenyl polyoxyethylene ether sulfate, Cu fatty alcohol polyoxyethylene ether ammonium sulfate, stearyltoluene sodium sulfonate, sec-alkyl sodium sulfate, nonylphenyl polyoxyethylene ether sulfate triethanolamine, glyceryl ethercarboxylic acid salt, calcium stearyl lactate, monoethanolamine dodecyl sulfate, alkoxy ethanolamido sulfosuccinate sodium salt, ammonium dodecylbenzenesulphonate, dodecay diethanol amine sulfate, sodium dibenzyl amine enzene sulfonate, and mixtures thereof.

Amphoteric or zwitterionic surfactants have both cationic and anionic centers on the same molecule. Under one embodiment, the cationic center is based on primary, secondary, or tertiary amines or quaternary ammonium cations. Under one embodiment, the anionic center comprises sulfonates, such as cocamidopropyl hydroxysultaine. Under one embodiment, the amphoteric surfactant is a betaine such as cocamidopropyl betaine.

Examples of amphoteric surfactants include lauryl betaine, betaine citrate, sodium lauroamphoacetate, sodium hydroxymethylglycinate, (carboxymethyl)dimethyl-3-[(1-oxododecyl)amino]propylammonium hydroxide, coco alkyldimethyl betaine, (carboxymethyl)dimethyloleylammonium hydroxide, cocoamidopropyl betaine, (carboxylatomethyl)dimethyl(octadecyl)ammonium, and mixtures thereof.

The composition of the present invention under some embodiments include an amine oxide surfactant. An amine oxide semi-polar nonionic surfactant, under some embodiments, comprises compounds and mixtures of compounds having the formula $R^1(C_2H_4)_nR^2R^3N\rightarrow O$, wherein $R^1$ is an alkyl, 2-hydroxyalkyl, 3-hydroxyalkyl, or 3-alkoxy-2-hydroxypropyl group, in which the alkyl and alkoxy, contain from 8 to 18 carbon atoms; $R^2$ and $R^3$ are each methyl, ethyl, propyl, isopropyl, 2-hydroxyethyl, 2-hydroxypropyl, or 3-hydroxypropyl, and n is from 0 to 10. In certain embodiments, the amine oxides are of the formula $R^1R^2R^3N\rightarrow O$, wherein $R^1$ is a $C_{12-16}$ alkyl and $R^2$ and $R^3$ are methyl or ethyl. In one embodiment the amine oxides comprise alkyl amine oxides, cocoamidopropyl amine oxide, or mixtures thereof. In one embodiment, the ratio of anionic surfactant to amine oxide surfactant is about 3:1 to about 4:1.

In certain embodiments, the aqueous cleaning composition comprises about 0.05 wt % to about 2 wt % surfactant. In certain embodiments, the aqueous cleaning composition comprises about 0.05 wt % to about 0.5 wt % surfactant.

The present invention is directed to an aqueous cleaning composition comprising a combination of polyalkylenimine and an acid; a surfactant; and a solvent mixture.

The solvent mixture comprises two or more solvents. Any of the solvents in the solvent mixture may be a mixture of selected compounds, some of which act as a solvent.

Under one embodiment, the aqueous cleaning composition comprises a solvent mixture which in turn comprises a glycol ether and an alcohol. Additional solvents, such as water, may be present in the aqueous cleaning composition in addition to the glycol ether and the alcohol.

Glycol ether solvent is particularly suitable for cleaners. Glycol ether solvent has the formula $R—O—(CH_2CH_2O)_m—CH_2CH_2—OH$, wherein m=0 or 1, and R is hydrocarbyl group comprising 1 to 7 carbons. The term "hydrocarbyl" means a univalent group comprising only carbon and hydrogen atoms; the hydrocarbyl group may be saturated, it may be unsaturated, it may be partially saturated, it may be branched, it may be linear, it may be alicyclic, it may be cyclic.

Examples of glycol ether solvents include, ethylene glycol monomethyl ether, 2-methoxyethanol, $CH_3OCH_2CH_2OH$, ethylene glycol monoethyl ether, 2-ethoxyethanol, $CH_3CH_2OCH_2CH_2OH$, ethylene glycol monopropyl ether, 2-propoxyethanol, $CH_3CH_2CH_2OCH_2CH_2OH$, ethylene glycol monoisopropyl ether, 2-isopropoxyethanol, $(CH_3)_2CHOCH_2CH_2OH$, ethylene glycol monobutyl ether, 2-butoxyethanol, $CH_3CH_2CH_2CH_2OCH_2CH_2OH$, ethylene glycol monophenyl ether, 2-phenoxyethanol, $C_6H_5OCH_2CH_2OH$, ethylene glycol monobenzyl ether, 2-benzyloxyethanol, $C_6H_5CH_2OCH_2CH_2OH$, propylene glycol methyl ether, 1-methoxy-2-propanol, $CH_3OCH_2CH(OH)CH_3$, diethylene glycol monomethyl ether, 2-(2-methoxyethoxy)ethanol, methyl carbitol, $CH_3OCH_2CH_2OCH_2CH_2OH$, diethylene glycol monoethyl ether, 2-(2-ethoxyethoxy)ethanol, carbitol cellosolve, $CH_3CH_2OCH_2CH_2OCH_2CH_2OH$, diethylene glycol mono-n-butyl ether, 2-(2-butoxyethoxy)ethanol, butyl carbitol, $CH_3CH_2CH_2CH_2OCH_2CH_2OCH_2CH_2OH$, and mixtures thereof.

Under one embodiment, the glycol ether is present in an amount ranging from about 0.1% to about 5% by weight of the composition. Under one embodiment, the glycol ether is present in an amount ranging from about 0.1% to about 2% by weight of the composition.

The solvent mixture, under one embodiment, comprises an alcohol. An alcohol is a compound comprising a hydroxyl functional group bound to a carbon. The alcohol may be a primary alcohol, secondary alcohol, or a tertiary alcohol. Under one embodiment, the alcohol solvent has the formula R—OH, wherein R is an organic group 1 to 8 carbons. The organic group may be saturated, it may be unsaturated, it may be partially saturated, it may be branched, it may be linear, it may be alicyclic, it may be cyclic. Further, the organic group may contain other groups such as ethers, or hydroxyl groups.

Examples of alcohol solvents include, tert-amyl alcohol, benzyl alcohol, 1,4-butanediol, 1,2,4-butanetriol, butanol, 2-butanol, n-butanol, tert-butyl alcohol, diethylene glycol, ethanol, ethylene glycol, 2-ethylhexanol, furfuryl alcohol, glycerol, isobutanol, isopropyl alcohol, methanol, 2-(2-methoxyethoxy)ethanol, 2-methyl-1-butanol, 2-methyl-1-pentanol, 3-methyl-2-butanol, neopentyl alcohol, 2-pentanol, 1,3-propanediol, 1-propanol, propylene glycol, propylene glycol methyl ether, and mixtures thereof.

Under one embodiment, the alcohol is present in an amount ranging from about 0.1% to about 10% by weight of the composition. Under one embodiment, the glycol ether is present in an amount ranging from about 1% to about 4% by weight of the composition.

The aqueous cleaning composition also comprises water. Under one embodiment, water is the major component of the aqueous cleaning solution. Under one embodiment, more 90% of the aqueous cleaning composition is comprised of water. Under one embodiment, more 91% of the aqueous cleaning composition is comprised of water. Under one embodiment, more 92% of the aqueous cleaning composition is comprised of water. Under one embodiment, more 93% of the aqueous cleaning composition is comprised of water. Under one embodiment, more 94% of the aqueous cleaning composition is comprised of water. Under one embodiment, more 95% of the aqueous cleaning composition is comprised of water.

Under one embodiment of the present invention, the composition is a concentrate, which comprises reduced water. The customer, or an intermediate party, dilutes the concentrate with water to obtain a suitable solution to be used for cleaning. The definition of the phrase "aqueous cleaning solution" includes concentrates that contain some or little water.

As a concentrate, the composition contains less than about 90% water. Under one embodiment, the concentrate comprises about 10% to about 20% water. Under one embodiment, the concentrate comprises about 10% to about 20% water. Under one embodiment, the concentrate comprises about 20% to about 30% water. Under one embodiment, the concentrate comprises about 30% to about 40% water. Under one embodiment, the concentrate comprises about 40% to about 50% water. Under one embodiment, the concentrate comprises about 50% to about 60% water. Under one embodiment, the concentrate comprises about 60% to about 70% water. Under one embodiment, the concentrate comprises about 70% to about 80% water. Under one embodiment, the concentrate comprises about 80% to about 90% water.

The aqueous cleaning composition is formulated to any pH suitable for a cleaning composition. In certain embodiments, the cleaning composition further comprises ammonia or ammonium hydroxide. Under one embodiment, the ammonia or ammonium hydroxide is present in an amount that provides a pH of about 9 to about 12. Under one embodiment, the ammonia or ammonium hydroxide is present in an amount that provides a pH of about 10 to about 12.

The present invention is directed to an aqueous cleaning composition comprising a combination of polyalkylenimine and an acid; a surfactant; a solvent mixture; and optionally, an additive.

Under one embodiment, the aqueous cleaning composition further comprises an acid additive. Under one embodiment, the acid additive is the same as the acid that combines with the polyalkylenimine. Under another embodiment, the acid additive is different from the acid that combines with the polyalkylenimine. Under one embodiment, the acid is a mixture of acids.

Examples of acids include, an organic acid, an inorganic acids, lactic acid, formic acid, citric acid, sorbic acid, acetic acid, glycolic acid, propanoic acid, propionic acid, oxalic acid, maleic acid, tartaric acid, adipic acid, malic acid, malonic acid, glycolic acid, and combinations thereof. Under one embodiment, the additive acid is present in an amount so that the pH of the aqueous cleaning composition is between about 2.0 and about 6.0. Under one embodiment, the additive acid is present in an amount so that the pH of the aqueous cleaning composition is between about 2.0 and about 4.5.

The optional additive, under one embodiment is a polysaccharide, such as xanthan gum. Xanthan gum may be present in the cleaning composition in an amount ranging from about 0% to about 1%, or from about 0.05% to about 1%, or from about 0.15% to about 0.5%.

Further, the aqueous cleaning composition of the present invention may optionally comprise other additives that may improve some property of the composition. Examples of further additives include colorants, fragrances, pro-fragrances, preservatives, rheology modifiers, structuring agents, hydrotropes, whitening agents, reducing agents, enzymes, enzyme stabilizing agents, builders, bleaches, photobleaches, bleach catalysts, soil release agents, dye transfer inhibitors, buffers, soil repellents, water-resistance agents, suspending agents, aesthetic agents, and combinations thereof. An exemplary preservative may include isothiazolinone. The further additives may be used in an efficacious amount.

Under one embodiment, the aqueous cleaning composition of the present invention comprises a combination of a branched polyethyleneimine and an acid selected from the group consisting of hydrochloric acid, phosphoric acid, acetic acid, and mixtures thereof, wherein the combination has a pH of less than about 2.5; sodium lauryl ether sulfate; and a solvent mixture comprising ethanol, propylene glycol n-butyl ether, and propylene glycol.

Under one embodiment, the aqueous cleaning composition comprises about 0.001 wt % to about 0.5 wt % of a combination of a branched polyethyleneimine and an acid selected from the group consisting of hydrochloric acid, phosphoric acid, acetic acid, and mixtures thereof, wherein the combination has a pH of less than about 2.5; about 0.1 wt % to about 2 wt % of sodium lauryl ether sulfate; about 0.1 wt % to about 3 wt % of ethanol; about 0.1 wt % to about 5.0 wt % of propylene glycol n-butyl ether, and about 0.1 wt % to about 2.0 wt % of propylene glycol. Additional ingredients include water.

In some embodiments, the pH is from about 2.5 to about 6.0. In other embodiments, the pH is from about 3.0 to about 5.5. In further embodiments, the pH is from about 3.0 to about 4.5. Still further embodiments provide compositions wherein the pH is from about 3.0 to 4.0.

The present invention is also directed to an aqueous cleaning composition comprising a combination of polyalkylenimine and an acid; a surfactant; a solvent mixture; and optionally, an additive, wherein the composition is a glass cleaner.

The phrase "glass cleaner" indicates a composition that is suitable for cleaning glass. The glass cleaner of the present invention is useful in cleaning objects made of glass. Examples of glass objects that the glass cleaner of the present invention is suitable for cleaning include windows, bathroom mirrors, shower doors, windshield, rear-view mirrors, bottles, lamps, light bulbs, glass containers, dishes, eyeglasses, sunglasses, magnifiers, readers, lenses, camera lenses, TV screens, computer monitors, cookware, artware, decanters, drinking glasses, and like. The glass cleaner of the present invention is suitable for cleaning glass made by any technique, including blown glass, cast glass, blow molded glass, slumped glass, spin glass, neon glass, plate glass, Murano glass, and like.

The glass cleaner of the present invention is also suitable for cleaning any substrate or surface that has properties which are in some way similar to glass. Such substrates include hard plastics, soft plastics, ceramics, metals, sealed stone, sealed wood, leather, enamel, tile, linoleum, and like. Household use include the cleaning and/or sanitizing of sinks, appliances, countertops, cutting boards, floors, toilet bowls, shower tiles, shower doors, faucets, fixtures, The glass cleaner of the present invention is also suitable for other uses besides cleaning surfaces. The glass cleaner of the present invention is also suitable for use as a jewelry cleaner, children's toys cleaner, kitty litter box deodorant, dry eraser marker remover, patio furniture cleaner, bug spray, laundry stain remover, and like.

The present invention is also directed to a method of cleaning a substrate. This method comprises the steps of applying the aqueous cleaning composition to a substrate; and wiping the composition across the substrate. This two step method is performed in this sequence: first, in the application step, the aqueous cleaning composition is applied to a substrate; second, in the wiping step, the composition is wiped across the substrate.

Under one embodiment, these two steps are preceded by one or more further steps. Under one embodiment, these two steps are followed by one or more further steps. Under one embodiment, these two steps are preceded by one or more further steps, and are followed by one or more further steps.

The present invention also includes methods that include one or more intermediate steps between the application step and the wiping step. Under one embodiment, the method comprises the application step, one or more intermediate steps, and the wiping step. Under one embodiment, the method comprises one or more preceding steps, the application step, one or more intermediate steps, and the wiping step. Under one embodiment, the method comprises the application step, one or more intermediate steps, the wiping step, and one or more following steps. Under one embodiment, the method comprises one or more preceding steps, the application step, one or more intermediate steps, the wiping step, and one or more following steps.

The application step may be performed in any manner that will deliver a sufficient amount of the aqueous cleaning composition to the substrate. Examples of such application step include spraying a portion of the surface with the aqueous cleaning composition from a spray bottle, spraying a portion of the surface with the aqueous cleaning composition from an aerosol can, pouring onto a portion of the surface the aqueous cleaning composition from a bottle, and like.

Under one embodiment, the application step delivers the aqueous cleaning composition to a portion of the substrate which the user desires to clean. Under one embodiment, the application step delivers the aqueous cleaning composition to all of the substrate which is desired to be cleaned.

The wiping step is performed to provide a coating of the aqueous cleaning composition to the entire substrate which the user desires to clean. Further, the wiping step is performed to remove the aqueous cleaning composition, along with any dirt or debris carried away by the aqueous cleaning composition.

The wiping step may be performed by any suitable tool. Examples of tools used to wipe the aqueous cleaning composition include a rag, cloth towel, paper towel, micro fiber cloth, newspaper, paper, squeegee, sponge, brush, hand, and like.

EXAMPLES

Four solutions of a glass cleaner was prepared by mixing the ingredients as in the Table 1.

TABLE 1

| Ingredient | Concentration (% wt) |
|---|---|
| Ethyl alcohol (96%, denatured) | 2.00 |
| Propylene glycol n-butyl ether | 2.00 |
| Sodium lauryl ether sulfate (28%) | 0.90 |
| 20% Lupasol PN60 & acid | 0.030 |
| Propylene glycol | 0.50 |
| Water | Q.S. to 100% |

The four formulations varied from each other in the identity of the acid. "Control" formulation had no acid added. The other formulations had acetic acid, hydrochloric acid or phosphoric acid, respectively, added. A sufficient amount of each acid was added to each solution as to achieve pH=2.

Lupasol PN60 is a commercial product from BASF, that contains about 40% polyethyleneimine. About 20% solution of Lupasol PN60 loaded at 0.030% wt means that the Control formulation comprises about 0.0024 wt % of polyethyleneimine.

The hydrophobic effect of such solutions were tested on a 60 cm×50 cm glass plate. The glass plate is representative of glass used in windows. Prior to each of the test, the glass plate was washed with hot water and then treated with ethanol and acetone.

Experiment 1

In the first experiment, the effect of using acids in a glass cleaner was performed. For each of the formulations, the glass plate was treated with the formulation by a method that approximated the procedure that a typical end user of a glass cleaner would use on a glass surface, such as a window or a mirror.

The contact angle of a water droplet on the glass plate treated with the glass cleaner formulations was measured with a Mobile Surface Analyzer (available from KRUSS GmbH, Hamburg, Germany) at 1 μL dosage, before and after solution application and after consecutive rinse cycles. At least 9 measurements were done for each formulation.

TABLE 2

| Composition | Contact Angle (°) | 95% Conf. Int. (°) |
|---|---|---|
| Control | 44.9 | 3.2 |
| Control & Acetic Acid | 34.6 | 2.1 |
| Control & Hydrochloric Acid | 41.1 | 2.2 |
| Control & Phosphoric Acid | 36.2 | 3.5 |

Table 2 shows that the use of acids decreased the contact angle compared to the Control.

Experiment 2

In the second experiment, the effect of rinsing the glass plate after the administration of the glass cleaner was investigated. In each case, the plate was treated with the glass cleaner formulation, and the contact angle for a 1 μL water droplet was measured. The plate was rinsed with water in a manner similar experienced by a window, mirror, or any other glass surface. The contact angle was then measured again. This was repeated seven times, on multiple sample. The data, with the mean and the 95% confidence interval for each, is tabulated in Table 3.

TABLE 3

| Rinse | Control | Acetic Acid | Hydrochloric Acid | Phosphoric Acid |
|---|---|---|---|---|
| 1 | 42.2 ± 13.5 | 27.8 ± 4.9 | 36.8 ± 6.6 | 32.7 ± 19.6 |
| 2 | 38.8 ± 7.8 | 31.3 ± 6.9 | 35.6 ± 7.3 | 29.8 ± 7.1 |
| 3 | 49.9 ± 15.6 | 30.8 ± 5.2 | 40.5 ± 4.8 | 34.8 ± 9.2 |
| 4 | 41.9 ± 9.4 | 34.4 ± 3.8 | 44.8 ± 6.9 | 34.8 ± 7.3 |
| 5 | 51.8 ± 9.0 | 41.0 ± 6.1 | 44.3 ± 5.4 | 40.5 ± 7.3 |
| 6 | 44.7 ± 6.4 | 38.4 ± 6.9 | 44.8 ± 6.6 | 40.5 ± 10.4 |
| 7 | 45.2 ± 9.4 | 38.4 ± 5.7 | 41.0 ± 6.9 | 40.2 ± 7.8 |

Table 3 shows several trends. Firstly. the data demonstrates that the formulations with acetic acid, hydrochloric acid and phosphoric acid yields a smaller contact angle than the control. This is consistent with the observations of Experiment 1. Secondly, the data shows that for each of the three formulations comprising acid, the contact angle increases somewhat with each successive rinsing, until about the fifth rinse, after which further rinses the contact angle does not change. This indicates that the formulation glass cleaner should be applied after as few rinses as possible, and its effects are likely not observed after about four rinses.

While the present invention has been described with reference to several embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention is to be determined from the claims appended hereto. Further, it will be apparent to those of skill in the art that numerous changes may be made in such details without departing from the spirit and the principles of the invention.

What is claimed is:

1. An aqueous cleaning composition comprising:

(a) about 0.03 wt % of a combination of polyalkylenimine and at least one acid selected from the group consisting of acetic, phosphoric, and hydrochloric, wherein the combination has a pH of less than 2.5;

(b) about 0.1 to about 2 wt % of at least one anionic surfactant selected from the group consisting of alkyl ether sulfate and triethanolamine alkyl sulfate;

(c) about 0.1 to about 3 wt % ethyl alcohol;

(d) about 0.1 to about 5 wt % propylene glycol n-butyl ether; and (e) about 0.1 to about 2 wt % propylene glycol, wherein a contact angle of a water droplet on a glass plate treated with the aqueous cleaning composition is 41.1° or lower, as measured with a Mobile Surface Analyzer (available from KRUSS GmbH, Hamburg, Germany) at 1 μL dosage.

2. The composition according to claim 1, wherein the polyalkylenimine is branched.

3. The composition according to claim 1, wherein the polyalkylenimine is polyethyleneimine.

4. The composition according to claim 2, wherein the polyalkylenimine comprises about 10% to about 30% primary amines, about 30% to about 70% secondary amines, and about 20% to 40% tertiary amines.

5. The composition according to claim 2, wherein the polyalkylenimine comprises about 5% to about 10% primary amines, about 20% to about 60% secondary amines, and about 20% to 40% tertiary amines.

6. The composition according to claim 1, wherein the acid is acetic acid.

7. The composition according to claim 1, wherein the anionic surfactant is sodium lauryl ether sulfate.

* * * * *